US006824247B2

(12) United States Patent
Duke et al.

(10) Patent No.: US 6,824,247 B2
(45) Date of Patent: Nov. 30, 2004

(54) PRINTER CARTRIDGE COMPATIBLE WITH PRINTHEAD

(75) Inventors: Charles B. Duke, Englewood, CO (US); Brandan J. Hill, Rio Rico, AZ (US)

(73) Assignee: Legacy Manufacturing, LLC, Denver, CO (US)

( * ) Notice: Subject to any disclaimer, the term of this patent is extended or adjusted under 35 U.S.C. 154(b) by 0 days.

(21) Appl. No.: 09/910,417

(22) Filed: Jul. 19, 2001

(65) Prior Publication Data

US 2002/0044166 A1 Apr. 18, 2002

Related U.S. Application Data

(60) Provisional application No. 60/219,169, filed on Jul. 19, 2000.

(51) Int. Cl.[7] ..... B41J 2/01
(52) U.S. Cl. ..... 347/49
(58) Field of Search ..... 347/49, 85–87

(56) References Cited

U.S. PATENT DOCUMENTS 5,245,361 A * 9/1993 Kashimura et al. ..... 347/50
5,619,239 A * 4/1997 Kotaki et al. ..... 347/86
6,027,208 A * 2/2000 Amano ..... 347/70

* cited by examiner

*Primary Examiner*—Michael Nghiem
(74) *Attorney, Agent, or Firm*—Gibson, Dunn & Crutcher LLP

(57) ABSTRACT

A ink printer cartridge is described that is compatible with a particular type of printhead. The printhead has a camming shoe having a horizontal pressing mechanism for pressing another type of ink cartridge and thereby mechanically holding the ink cartridge in place. The cartridge according to the present invention has a shape and size that it does not engage the camming shoe, rather the cartridge engages an interior surface of the top of the printhead. In this way, a cartridge can be constructed to be used in a printer having a printhead with a camming shoe, which does not use the camming shoe in any way whatsoever.

6 Claims, 7 Drawing Sheets

SECTION C-C

SECTION A-A

SECTION B-B

SECTION C-C

PRINTER CARTRIDGE COMPATIBLE WITH PRINTHEAD

CROSS REFERENCE TO RELATED APPLICATION

This application claims priority from provisional patent application No. 60/219,169 filed Jul. 19, 2000, the contents of which are incorporated by reference.

BACKGROUND

The invention relates to the filed of ink printers, and more particularly to a cartridge that is compatible with a particular type of printhead.

It is well known and indeed the universal practice to have ink printers such as are commonly used with personal computers (PC) equipped with replaceable cartridges that store the ink that is used with printers. The cartridges are replaceable so that when the ink supply in a particular cartridge is exhausted, the user need simply the replace the spent cartridge with a new cartridge having ink to continue operation of the printer. It is also well known to have 2 separate cartridges: one storing black ink and the other storing the three primary colors. Because users typically use much more black ink than color ink (or in any event, use black ink at a different rate than color ink), it is advantageous to have the black ink cartridge separately replaceable to avoid wasting ink when a cartridge is replaced.

The present invention relates solely to the mechanical fit of an ink cartridge with a particular type of printhead as described below, and the remaining portions of the ink cartridge can be constructed in way that is desired by a manufacturer, as is well known in the art.

SUMMARY

The present invention relates to a printer cartridge that is compatible with a particular printhead, such as a printhead as described in U.S. Pat. No. 5,619,239 of Kotaki et al., issued Apr. 8, 1997, the contents of which are hereby incorporated by reference. Nothing herein should be construed as an admission of the validity or scope of the '239 patent. Rather, the present invention presents an alternative design.

The '239 patent discloses a camming shoe (denoted as component 105*a*) having a horizontal pressing means 105*b*. The pressing means (denoted as component 105*b*) generates a downward force to press down onto the ink container. While the system disclosed in said patent may (or may not) have a certain level of functionality or advantages in comparison with other systems, it has been discovered that it is unnecessary for the ink cartridge to engage the camming shoe in order to effectively seat within the printhead. The present invention relates to that discovery.

The terminology employed herein is not necessarily the same as in the '329 patent. Herein, the "cartridge" is the replaceable, removable ink storing member that fits within the "printhead"—the term cartridge herein generally refers to term "ink tank" in the '329 patent.

DETAILED DESCRIPTION OF THE INVENTION

The invention relates to a number of features in a printer cartridge intended for use in an ink jet printer, although the invention is not limited to any particular field of use. The cartridge is described in overview, and then more particular aspects of the invention are described.

Figure 1:
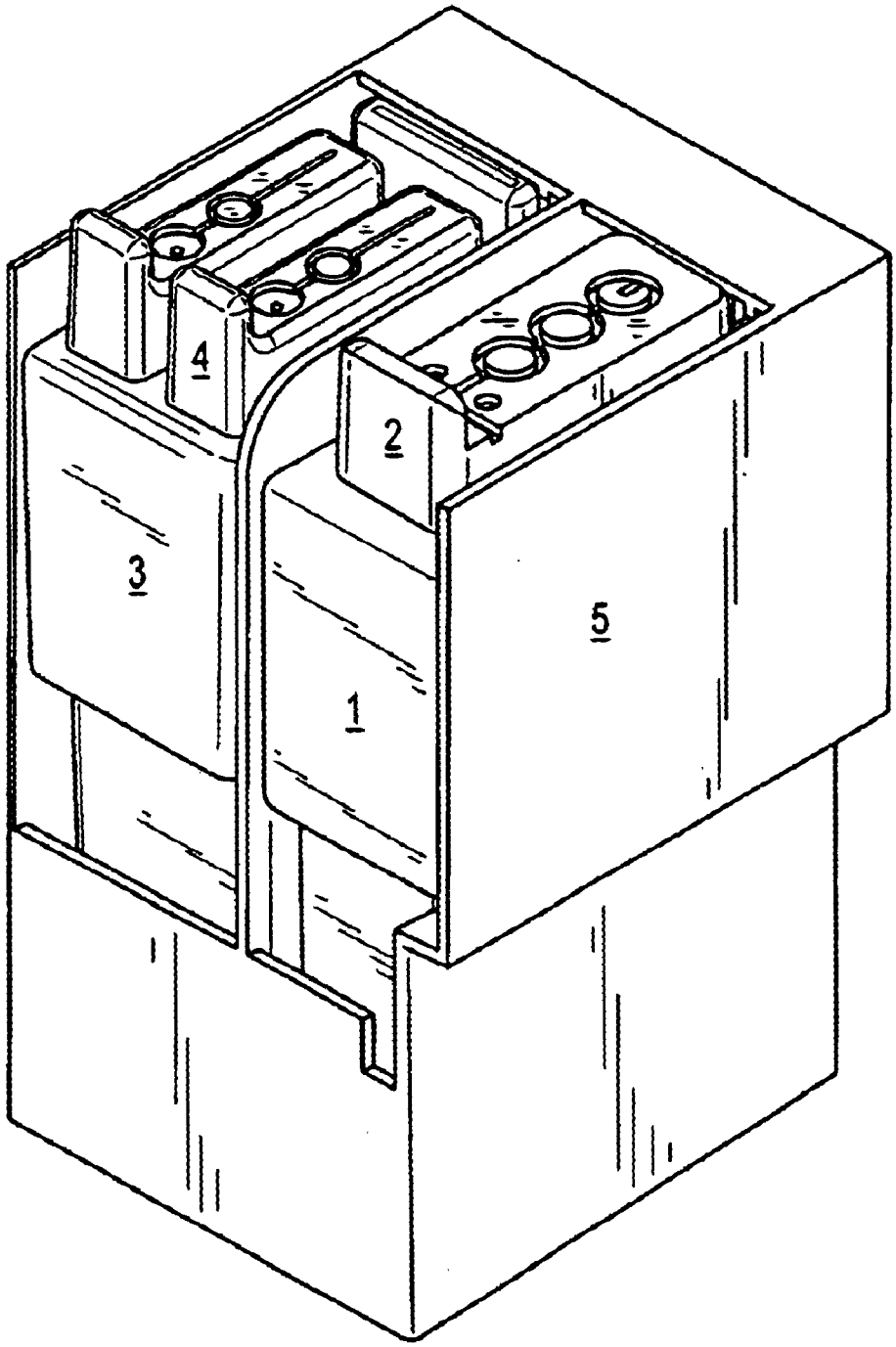
FIG. 1 is a perspective view of an embodiment of the present invention situated within a printhead, fully engaged.

Referring to FIG. 1, the base 1 defines the boundary of the black ink cartridge (in conjunction with lid 2), and is profiled to mechanically key into a mating printhead 5 so that ink can be withdrawn from the ink chamber within the cartridge into the printhead. The lid 2 is hermetically sealed with the base, and through suitable vent means provides a pathway for communication of the ink chamber with the atmosphere. As explained below, the surface of the lid is provided with two features dimensioned to engage the printhead and create downward pressure of the cartridge onto the printhead nozzle openings.

The base 3 defines the boundary of the tri-color ink cartridge (in conjunction with lid 4). For the purpose of this invention, the base 3 and lid 4 are precisely analogous to base 1 and lid 2, and therefore require no separate elaboration.

Figure 2:
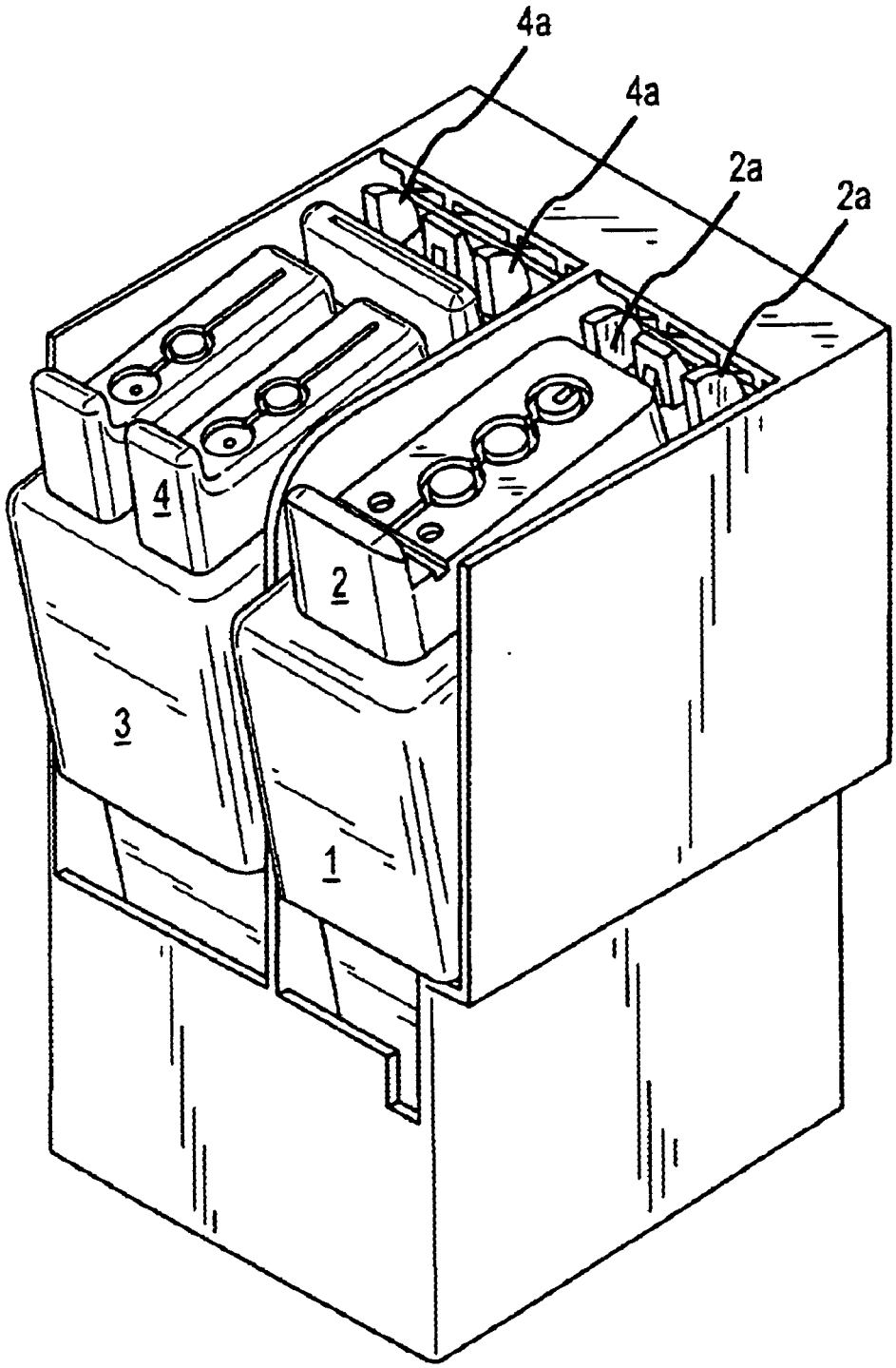
FIG. 2 is a perspective view of an embodiment of the present invention shown within the printhead, before it is fully engaged.
Figure 3:
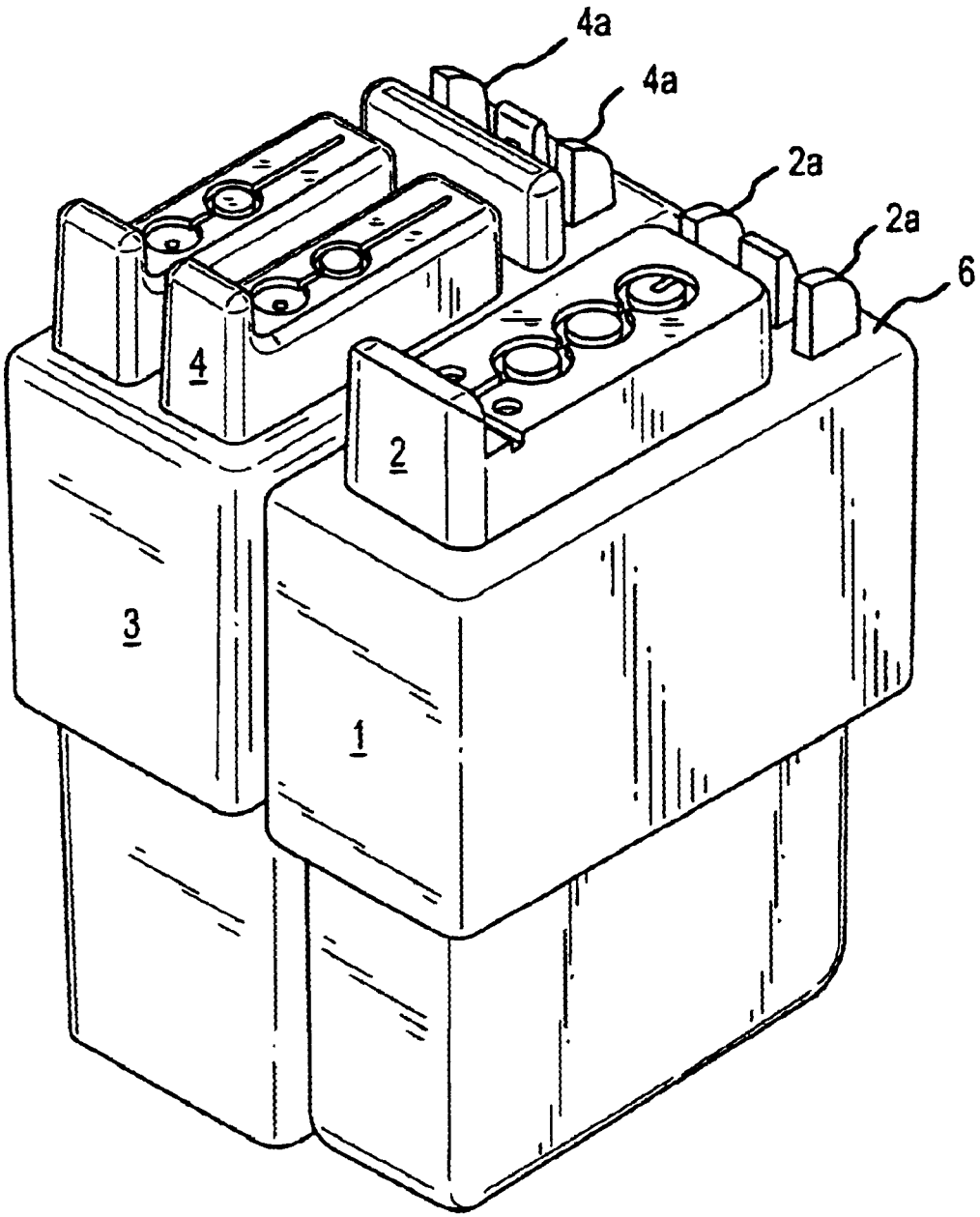
FIG. 3 is a perspective view of an embodiment of the present invention shown without the printhead.
Figure 4:
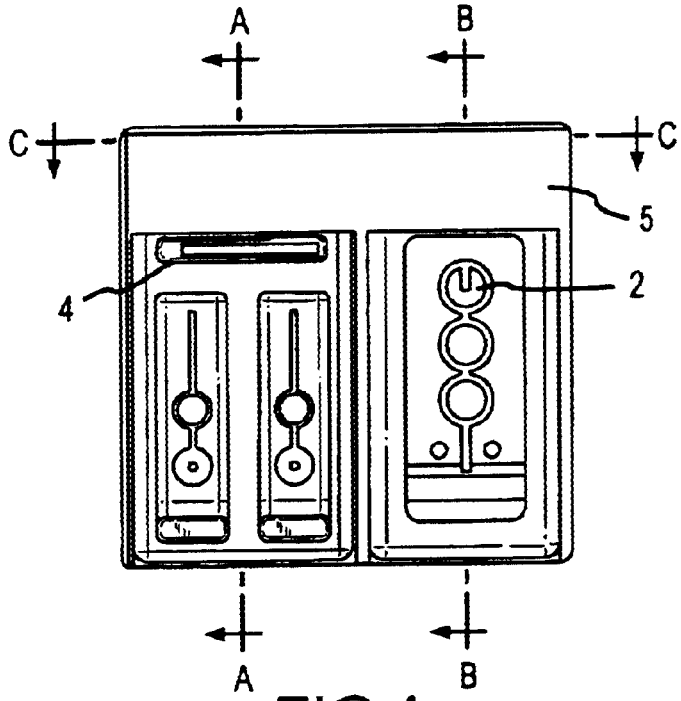
FIG. 4 is a top view of an embodiment of the present invention, shown within the printhead.
Figure 5:
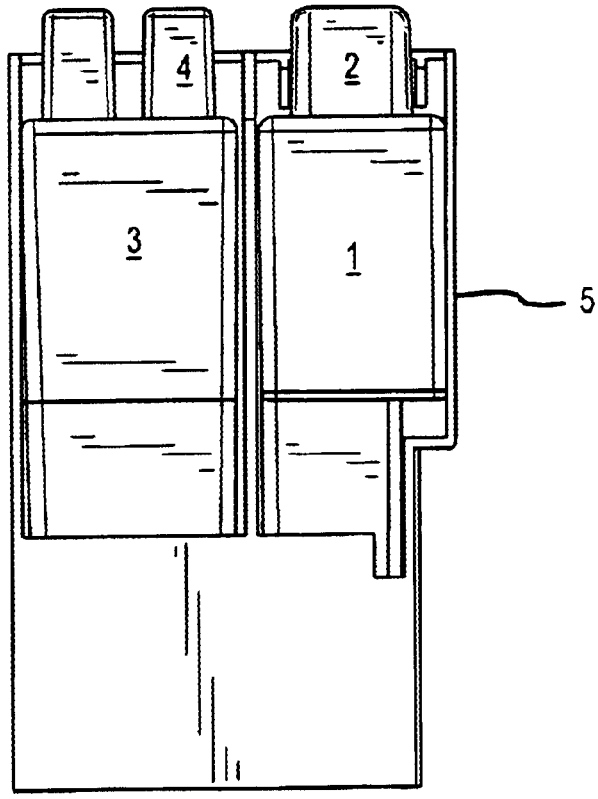
FIG. 5 is a front elevation view of an embodiment of the present invention.
Figure 6:
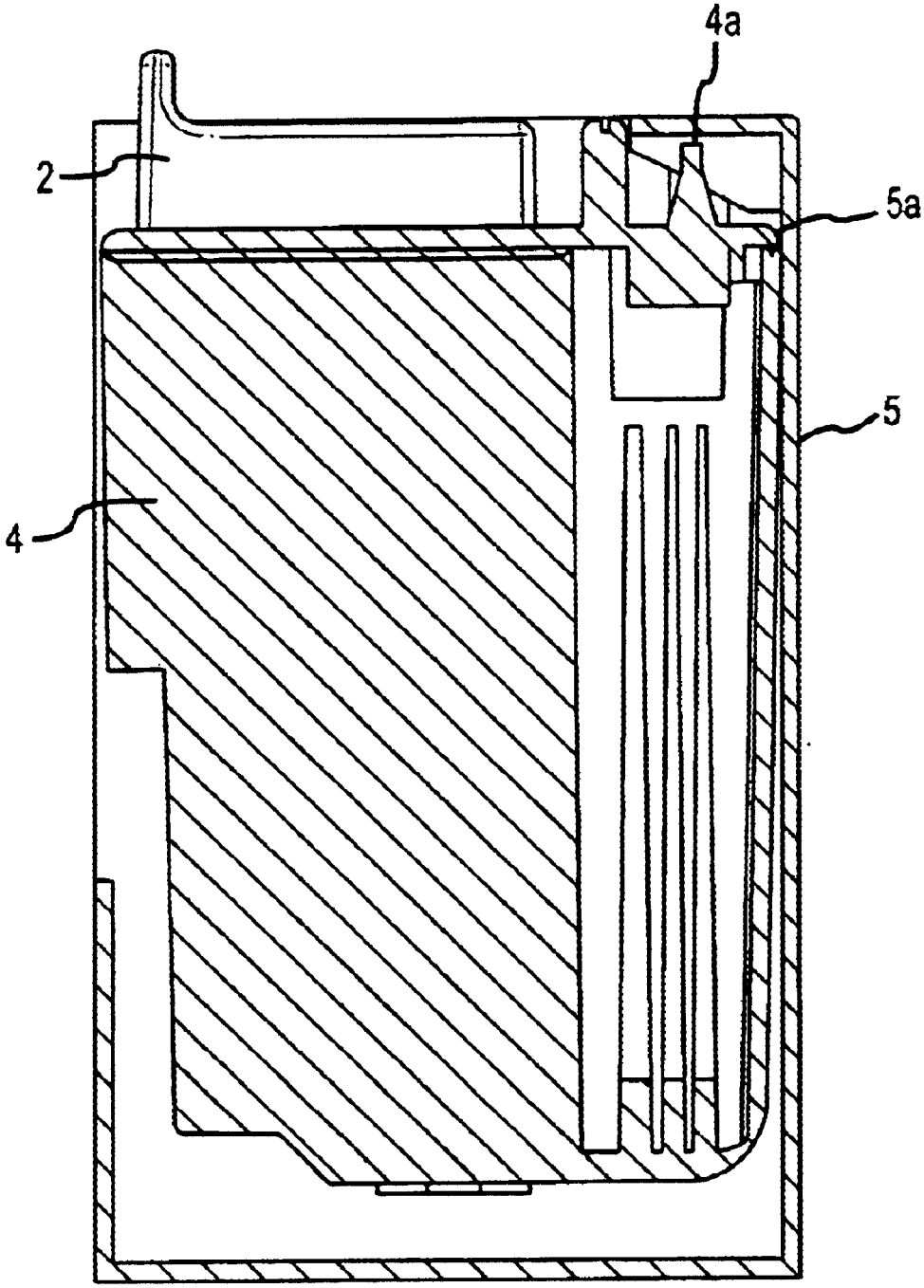
FIGS. 6, 7, and 8 are section views taken respectively along the lines A—A, B—B, and C—C of FIG. 4.
Figure 7:
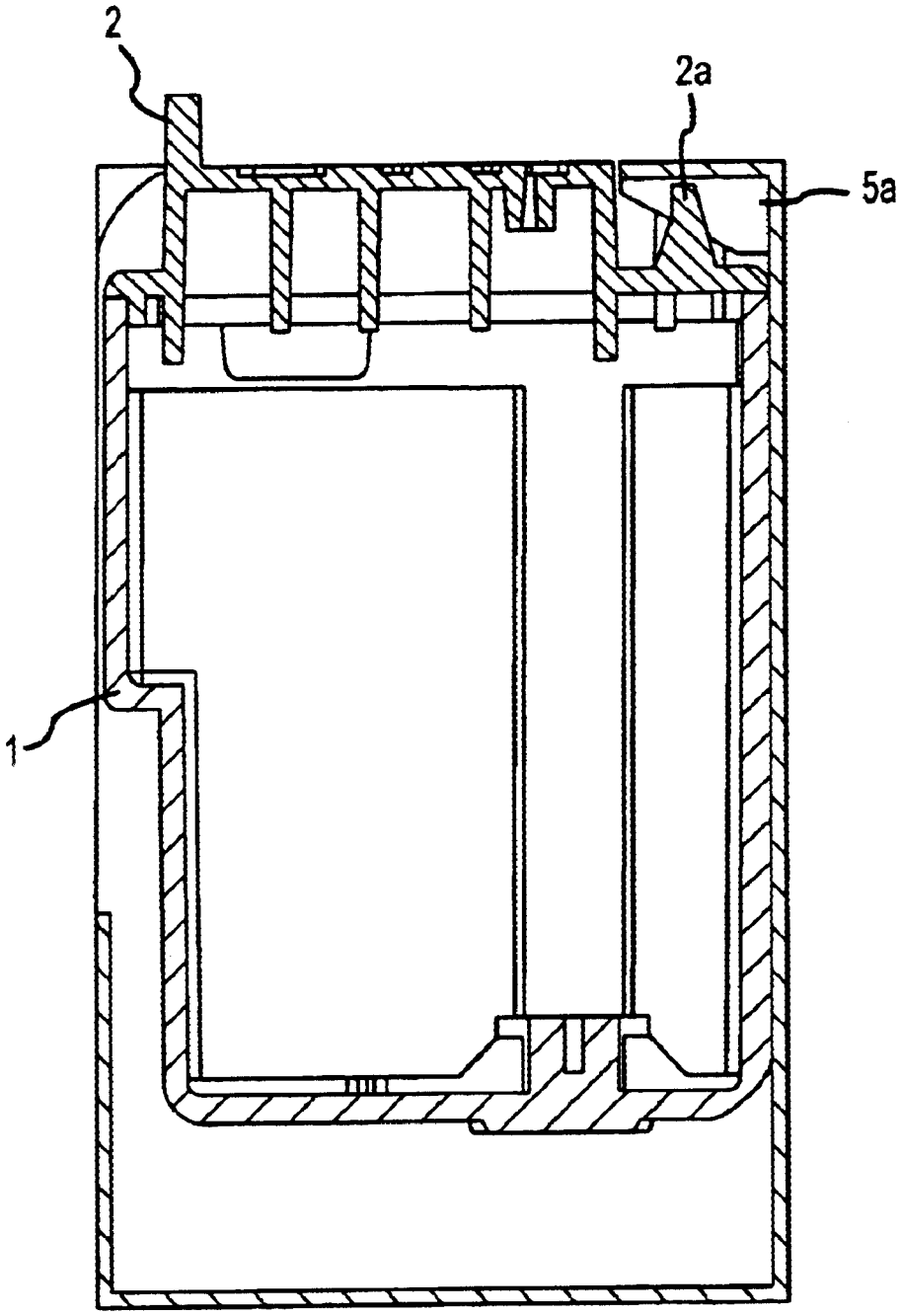

FIG. 2 shows the black ink cartridge and the tri-color cartridge partially inserted into the printhead 5. That is, the cartridges have been placed in the printhead 5 but have not fully engaged the printhead, and there is no downward force. The cartridges are not operable in this placement because air would be aspirated into the printhead nozzles, which would lead to print failure.

Figure 8:
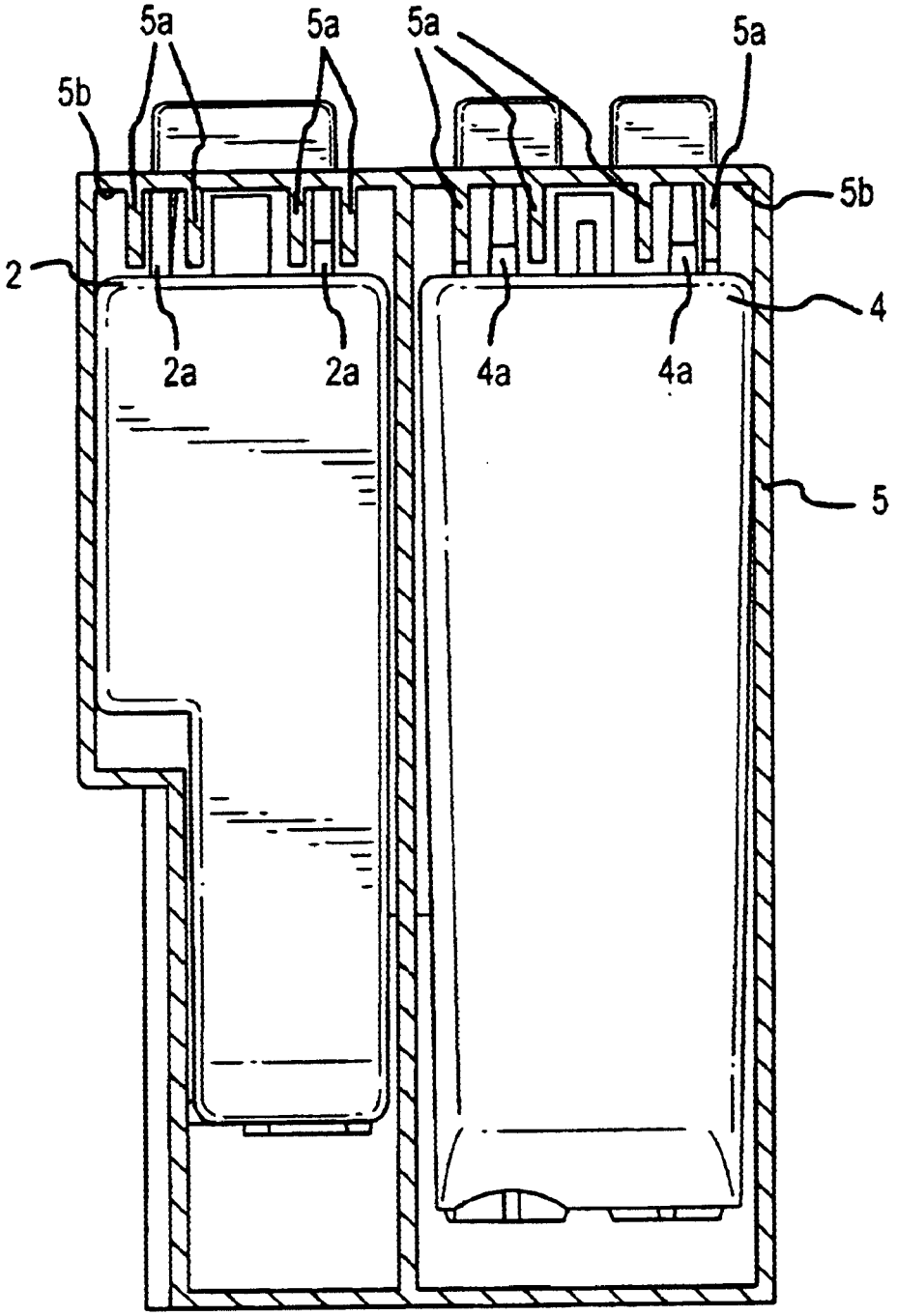

FIG. 8 shows a section view of the black ink cartridge and tri-color cartridge after they have been fully inserted within the printhead 5. This view illustrates the engagement of the black ink cartridge and tri-color cartridge with the printhead 5. As can be seen, the lid 2 has a primary surface 6 that does not contact the camming shoe (denoted 5*a*) of the printhead 5, so there is a clear space therebetween. As can be seen, the camming shoe comprises a series of vertically spaced tabs which extend downward from the interior surface of the top of the printhead, denoted 5*a*. Instead, the features 2*a* contact the interior surface 5*b* of the top of the printhead 5. As shown in the drawings, the features 2*a* are offset from the spaced tabs 5*b* and have a sufficient length to contact surface 5*b*. The black ink cartridge is sized so that engagement of the features 2*a* with the surface 5*b* causes a press fit of the cartridge within the printhead 5, therefore allowing proper printing to occur.

In connection with the tri-color cartridge, features 4*a* engage the surface 5*b* in exactly the same manner as the features 2*a*, providing the same benefit and allowing a clear space to exist between lid 4 and the camming shoe 5*a*.

It will be appreciated that a number of features of the cartridge have been described above, and that not every feature need be incorporated into any particular embodiment of the invention disclosed herein. Further, the scope of any claims arising from this application shall be limited only by the scope and content of the prior art. As contemplated, the present invention includes a printer cartridge as described herein alone or in combination with a printhead.

What is claimed is:

1. An ink printer cartridge for use in an ink printer having a printhead having an interior surface and a camming shoe extending downward front the interior surface, the camming shoe having a pressing means which includes a series of vertically oriented spaced tabs having clear spaces therebetween, the ink printer cartridge comprising:

a base and a lid attached to the base, the lid having at least one protrusion extending upward from the lid so that when the base is fully inserted within the printhead, the protrusion engages the printhead interior surface and no part of the protrusion engages the camming shoe, no part of the base engages the camming shoe, and no part of the lid engages the camming shoe.

2. The ink printer cartridge of claim 1, wherein the at least one protrusion is two protrusions.

3. The ink printer cartridge of claim 1, wherein the ink printer cartridge lid has a primary surface which, when the cartridge is engaged with the printhead, is beneath the vertical tabs of the camming shoe so that there is clear space between the ink printer cartridge primary surface and the camming shoe, and the at least one protrusion is offset from the vertical tabs of the pressing means and has a sufficient length so that it contacts the printhead interior surface.

4. The combination comprising: an ink printer printhead having an interior surface and a camming shoe extending downward from the interior surface, the camming shoe having a pressing means which includes a series of vertically oriented spaced tabs having clear spaces therebetween; and an ink printer cartridge having a base and a lid attached to base is fully inserted within the printhead, the protrusion engages the printhead interior surface and no part of the protrusion engages the camming shoe, no part of the base engages the camming shoe, and no part of the lid engages the camming shoe.

5. The combination of claim 4, wherein said at least one protrusion is two protrusions extending upward from the lid.

6. The combination of claim 4, wherein the at least one protrusion is offset from the vertical tabs of the pressing means and has a length such that the protrusion fits between the vertical tabs of the pressing means and extends a sufficient distance to contact the interior surface of the printhead.

* * * * *